United States Patent [19]

Metoki et al.

[11] Patent Number: 4,659,654

[45] Date of Patent: Apr. 21, 1987

[54] SILVER HALIDE PHOTOGRAPHIC LIGHT-SENSITIVE EMULSION

[75] Inventors: Iku Metoki; Akio Suzuki; Eiji Yoshida; Kiyoshi Sato; Masumi Hosaka, all of Hino, Japan

[73] Assignee: Konishiroku Photo Industry Co., Ltd., Tokyo, Japan

[21] Appl. No.: 780,379

[22] Filed: Sep. 26, 1985

[30] Foreign Application Priority Data

Sep. 28, 1984 [JP] Japan ..... 59-201976

[51] Int. Cl.[4] ..... G03C 1/19; G03C 1/08

[52] U.S. Cl. ..... 430/567; 430/569; 430/588; 430/599; 430/603; 430/604; 430/605; 430/966

[58] Field of Search ..... 430/588, 585, 567, 569, 430/599, 603, 604, 605, 966

[56] References Cited

U.S. PATENT DOCUMENTS

| | | | |
|---|---|---|---|
| 2,912,329 | 11/1959 | Jones et al. | 430/588 |
| 3,397,060 | 8/1968 | Schwan et al. | 430/588 |
| 3,615,635 | 10/1971 | Shiba et al. | 430/588 |
| 3,628,964 | 12/1971 | Shiba et al. | 430/588 |
| 4,444,877 | 4/1984 | Koitabashi et al. | 430/567 |
| 4,477,564 | 10/1984 | Cellone et al. | 430/567 |
| 4,510,235 | 4/1985 | Ukai et al. | 430/588 |
| 4,565,778 | 1/1986 | Miyamoto et al. | 430/567 |

*Primary Examiner*—Won H. Louie

*Attorney, Agent, or Firm*—Jordan B. Bierman

[57] ABSTRACT

A silver halide photographic light-sensitive emulsion contains silver halide particles, chemically sensitized, the average concentration of the silver iodide of which is from 0.5 to 10 mole % and which have inside part wherein not less than 20 mole percent silver iodide is present locally; and at least one cyanine dyes having the Formulas [I], [II] and [III] as herein described.

24 Claims, 2 Drawing Figures

SILVER HALIDE PHOTOGRAPHIC LIGHT-SENSITIVE EMULSION

BACKGROUND OF THE INVENTION

The present invention relates to a silver halide photographic light-sensitive emulsion which, for example, by being formed as an emulsion layer on a support such as film, is utilized as a photographic light-sensitive material.

In recent years, with the development of photographic technology, further increasing the sensitivity of photographic light-sensitive materials has been strongly demanded; that is, increasing the sensitivity of photographic light-sensitive materials in order to meet the respective needs of, e.g., using high shutter speeds of cameras; rapidly processing color and black-and-white photographic papers; electronically automating or simplifying the processing in the graphic arts field; lowering the medical X-ray dose; and the like.

To take the medical radiographic field as an example, those conventional regular-type X-ray films, sensitive to the wavelength region of around 450 nm, are now replaced by orthochromatic-type radiographic films, which are orthochromatically sensitized so as to be sensitive to the wavelength region of 540 to 550 nm. In those thus sensitized films, not only is the wavelength region to which they are sensitive extended but also their sensitivity to X-rays is increased, and therefore they permit reducing X-ray dose, thus enabling to minimize the influence of X-rays upon the human body.

As for the technology of increasing the sensitivity of photographic light-sensitive materials, many researches and developments have been made to date, and a number of useful means have been found. As one of them, the technique of using sensitizing dyes, i.e., the so-called "spectral sensitization" is known. The technique is very useful means for the sensitization, but has many problems yet to be solved. For example, there are cases where the spectral sensitization by use of sensitizing dyes is unable to make any adequate sensitization, depending on the type of photographic emulsion; the preservability of an emulsion after its sensitization is not enough, i.e., the sensitivity of the emulsion becomes deteriorated or color-stained with time; the sensitized emulsion tends to be sensitive to the conventional safelight thereby to be fogged; and the like,—these problems remain unsolved. Particularly, regarding the problem of the sensitized emulsion being fogged by the safelight, various measures have hitherto been taken for the applying quantity, method, etc., of sensitizing dyes to the emulsion, but such measures, on the contrary, sometimes badly impair the sensitization effect, thus making the addition of sensitizing dyes to the emulsion meaningless.

In various light-sensitive materials, even though the sensitivity thereof is raised by sensitizing means, the emulsion thereof is sometimes blackened or desensitized by various mechanical pressure applied thereto prior to being exposed (blackened trouble found after development and desensitization found during development, both being caused by mechanical pressure applied before exposure.). Particularly, medical X-ray film, because its size is large, is sometimes bent from its own weight to produce film folds such as knick marks to thereby tend to cause blackened or desensitized trouble by pressure. Lately, as the medical radiographic system, automatic exposure and developing apparatuses which use automatic transport mechanism are extensively used. In such apparatuses, mechanical force is applied to film, and the mechanical force, particularly in a dry place, tends to cause the above-mentioned blackened or desensitized trouble on the film. Such the trouble will possibly cripple the medical diagnosis.

There have until now been proposed various methods for restraining the occurrence of such blackened and desensitized troubles by pressure; for example, those methods of adding gelatin plasticizers as described in U.S. Pat. No. 3,655,390, British Pat. No. 1,307,373, U.S. Pat. No. 3,772,032, etc.; those methods of adding pressure fog-preventing agents as described in U.S. Pat. Nos. 3,655,390, 3,445,235, 2,628,167, etc,; and the like.

As the above gelatin plasticizer, the above publications describe polymer dispersoids such as latexes and hygroscopic substances, but these are considered unfavorable because they affect the sensitivity, produce fog, or adversely affect the physical property, such as the adherence of the layer to the support, of a light-sensitive material.

As the latter pressure fog-preventing agent, the above publications disclose amine-borane compounds, iridium-rhodium salts, and water-soluble bismuth salts, but these deteriorate the sensitivity.

SUMMARY OF THE INVENTION

This invention has been made in view of the above circumstances. It is therefore an object of the present invention to provide a practically useful silver halide photographic light-sensitive emulsion which has little fog and a high sensitivity; which is free from the problems of being fogged by the safelight due to its sensitization and of color-stain caused during its storage; and which is also free from the problem, in the film produced from the emulsion, of the blackened trouble by pressure such as knick marks caused in handling the film.

In order to accomplish the above object of this invention, the silver halide photographic light-sensitive emulsion of the invention comprises silver halide particles, chemically sensitized, whose average silver iodide concentration is not less than 0.5 mole%, and which have thereinside part wherein not less than 10 mole% silver iodide is present locally; and at least one of those compounds having the following formulas [I], [II] and [III]:

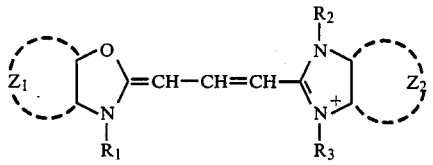

[I]

$(X_1^-)_{n-1}$

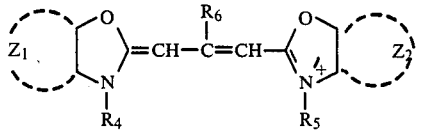

[II]

$(X_2^-)_{n-1}$

-continued

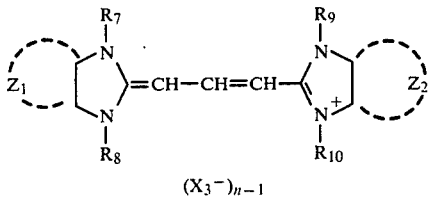

[III]

In Formulas [I], [II] and [III], $X_1^-$, $X_2^-$ and $X_3^-$ each is an anion, $Z_1$ and $Z_2$ each is a group of nonmetallic atoms necessary to complete a substituted or unsubstituted benzene ring, and n represents 1 or 2, provided n is 1 when forming an intramolecular salt.

In Formula [I], $R_1$, $R_2$ and $R_3$ each is a substituted or unsubstituted alkyl, alkenyl or aryl group, provided at least one of the $R_1$ and $R_3$ is a sulfoalkyl or carboxyalkyl group.

In Formula [II], $R_4$ and $R_5$ are as defined in the $R_1$ and $R_3$, and $R_6$ is a hydrogen atom, a lower alkyl or aryl group.

In Formula [III], $R_7$ and $R_9$ each is a substituted or unsubstituted lower alkyl, and $R_8$ and $R_{10}$ each is a lower alkyl, hydroxyalkyl, sulfoalkyl or carboxyalkyl group.

As has been described above, the silver halide photographic light-sensitive material of this invention produces little fog; can be highly sensitized; shows almost no color stain; is excellent in the immunity from being fogged by safelight; and has the effect of being free from the problem caused in the sensitization thereof and also from the problem of being blackened pressure because of being excellently stable against pressure. And the invention enables to accomplish these effects without adversely affecting the resulting image quality.

DETAILED DESCRIPTION OF THE INVENTION

Figure 1:
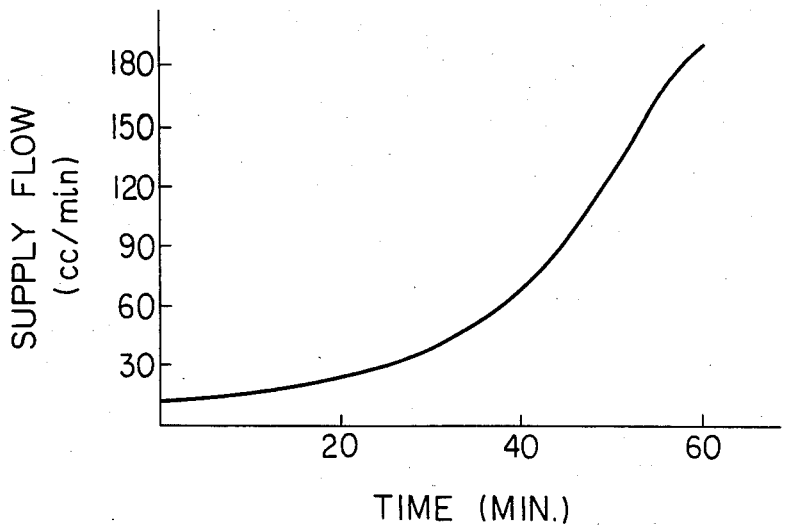
FIG. 1 is a graph showing the profile of the supply flow of silver ion and halide ion during the growth of the silver halide particles of the samples in the example.

The present invention will be further illustrated.

The silver halide particles in the emulsion of this invention are of a silver halide containing silver iodide, and the silver halide is allowed to be any of silver iodochloride, silver iodobromide or silver chloroiodobromide. Substantially, silver iodobromide is suitable for obtaining a high sensitivity.

The average silver iodide content of such silver halide particles is not less than 0.5 mol%, preferably from 0.5 to 20 mole%, and more preferably from 0.5 to 10 mole%, and further preferably from 1 to 8 mole%. The use of the above average silver iodide content enables to obtain an emulsion which has a high sensitivity and little fog, and which is hardly sensitive to a safelight.

It is preferred that the silver halide emulsion of the invention containing a group of silver halide particles is to be uniform in the concentration of silver iodide contents between the particles.

Such silver halide particles each has thereinside silver iodide-localized part wherein silver iodide as highly concentrated as not less than 10 mole% is present locally, and preferably not less than 20 mole% in concentration.

In this instance, the intraparticle part is desirable to be located at as much inner side as possible from the external of the particle, and particularly the localized part is desirable to be present at a position not less than 0.01 μm and more desirably not less than 0.02 μm, and further desirably not less than 0.04 μm, apart from the external surface of the particle.

The localized part may be present in the stratified form inside the particle, or may be of a so-called core/shell-type structure having the different concentration of silver iodide and its entire core constituting the localized part. In this instance, part of or the whole of the particle core portion, excluding the shell portion in which the concentration of silver iodide is less than that in the core portion and the thickness thereof is not less than 0.01 μm from the external surface, is desirable to be the localized part containing not less than 20 mole% silver iodide, and it is preferred that the silver contents in the shell portion is in an amount of from 5 to 95 mole% to the silver contents in the whole particle.

In addition, the concentration of the silver iodide of the localized part is desirable to be in the range of from 30 to 40 mole%.

The external of this localized part is preferably covered with a silver halide having relatively less concentration of silver iodide than that of the lacalized part and, in this instance, the concentration of the covering silver iodide is preferably not more than 10 mole%, and more preferably not more than 5 mole%. It is, more preferably, to be covered with a silver halide containing no silver iodide. That is, in a preferred embodiment of the invention, the shell portion having a thickness of not less than 0.01 μm, particularly from 0.01 to 1.5 μm, from the external surface, is formed by a silver halide containing silver iodide (preferably, silver bromide) of not more than 10 mole%.

In this invention, the method for the formation of an at least not less than 20 mole% high-concentration silver iodide-localized part inside the particle (preferably not less than 0.01 μm inner from the external surface of the particle) is desirable to be a method using a seed crystal, but is also allowed to be another method using no seed crystal.

In the case of not using any seed crystal, to a protective gelatin-containing reaction liquid phase (hereinafter called "mother liquor"), since there is no silver halide to become a growth nucleus before the start of ripening, are first supplied silver ion and halide ions containing at least not less than 10 mole% and preferably not less than 20 mole% high-concentration iodide ion to thereby form a growth nucleus. And the supply is further continued to grow a particle from the growth nucleus. Finally, on this is formed a shell layer having a thickness of not less than 0.01 μm with a silver halide containing silver iodide of not more than 10 mole%.

When using a seed crystal, the seed crystal is to be contained with silver iodide of not less than 10 mole% and preferably not less than 20 mole% in concentration and is then grown to form a grown part, and after that it may be covered with the aforementioned shell layer. Alternatively, the silver iodide content of the seed crystal may be settled in the range of zero to 10 mole%, and at least 10 mole% and preferably not less than 20 mole% silver iodide may be formed thereon, inside the particles and after that it may be covered with the aforementioned shell layer.

In this instance, it is preferred that the silver halide in the grown part is to comprise silver iodobromide containing silver iodide of not less than 20 mole% in concentration. It is also preferred that the silver halide contents in the grown part is in an amount of from 3 to 50 mole% to the silver halide contents of whole particle. It is, further, preferred that the silver halide contents in the aforementioned seed crystal is in an amount of from 1 to 50 mole% to the silver halide contents of the whole particle.

In this instance, because in this invention the proportion in quantity of the silver iodide to the whole silver halide of the particle is in the range of not less than 0.5 mole% and preferably from 0.5 to 10 mole%, the particle size in the former method becomes larger than that of the one in the latter and thus the particle size distribution becomes wider. The one having a multistructure as in the latter is accordingly more preferred in this invention because a monodisperse emulsion is more easily obtainable therefrom.

Further, a halogen-substitution method is also allowed to serve as a method of forming a layer in the localized portion. The applicable halogen-substitution methods include, for example, a method in which an aqueous solution of an iodide compound is added after forming seed crystals, as decribed in U.S. Pat. Nos. 259,250 and 4,075,020, and Japanese Patent Publication Open to Public Inspection No. 127549/1980, and the like.

The silver halide particles used in this invention may be in irregular form such as in the potato form, however, they are desirable to be ones being of a regular construction or configuration. For example, they are desired to be in the regularly crystallized forms such as a hexahedron, octahedron, dodecahedron, tetradecahedron and the like. Particularly, silver halide particles comprised substantially of regular crystals are preferred. In the invention, when a silver halide photographic light-sensitive emulsion containing silver halide particles of the invention which are preferably regular crystals is to be used in a photographic light-sensitive material, the contents of the silver halide particles is preferably not less than 40% by weight of silver to the whole amount of silver of emulsion, and more preferably not less than 70% by weight, and particularly 100% thereto. Because such particles facilitate obtaining a monodisperse emulsion, and, generally, the monodisperse emulsion is easily chemically sensitizable as compared to polydisperse emulsions, thus enabling to well exhibit the effect of this invention.

The groups of silver halide to be contained in the emulsions of the invention are, preferably, a monodisperse emulsion.

To be concrete, the particles are such that, if the average particle size is expressed as $\bar{r}$ and the standard deviation thereof as $\sigma$, then the coefficient of variation ($\sigma/\bar{r}\times 100$) is not more than 20%. In addition, the $\bar{r}$ and $\sigma$ may be obtained through the measurement, under a microscope, of a side or the diameter of each of not less than 500 particles.

The average particle size of the silver halide emulsions capable of being used in the invention may be the same as those of the emulsions being popularly used, and it is nevertheless preferable to be in the range of from 0.4$\mu$ to 5.0$\mu$.

The emulsion, by being a monodisperse emulsion comprised of such particles, can be adequately sensitized by chemical sensitization, etc., thereby to be a very highly sensitive emulsion, and yet the gradation thereof is hardly softened even by the sensitization, and thus it can be a high-contrast emulsion.

In order to prepare the above-mentiond monodisperse emulsion, a growth of the silver halide crystal particles are first performed. For the growth of the crystal particles, silver ion and a halide solution may be alternately added in time series, and more preferably added in the double jet method.

And the supply of the silver ion and halide ion does not dissolve out the existing crystal particles in the course of the growth thereof nor permits the generation or growth of new particles to the contrary; namely the supply gradually increases the growth continuously or step-by-step at a marginal growth rate or in the allowable range thereof which regulates the supply of the silver halide so as to be necessary as well as enough for the growth of the existing particles alone. Descriptions about this gradually increasing method are found in Japanese Patent Examined Publication Nos. 36890/1973 and 16364/1977, and Japanese Patent Publication Open to Public Inspection (hereinafter referred to as Japanese Patent O.P.I. Publication) No. 142329/1980.

This marginal growth rate varies according to the temperature, pH, pAg, stirring rate, composition of the silver halide particles, solubility, particle sizes, distance between the particles, crystal habit, the type and concentration of the protective colloid, or the like, and can be easily obtained on the experimental basis through the microscopic observation of the emulsion particles suspended in a liquid phase and the measurement of the turbidity thereof.

And, by gradually increasing the supply speed at the marginal addition rate or in the allowable range thereof, a monodisperse emulsion, whose particle size's coefficient of variation is not more than 20%, can be obtained.

The preferred manner of obtaining the above monodisperse emulsion is such that particularly seed crystals are used, and to the seed crystals as the growth nuclei are supplied silver ion and halide ion to thereby grow the particles.

The wider the seed particle sizes' distribution, the wider the grown particle sizes' distribution. Accordingly, in order to obtain a monodisperse emulsion it is desirable to use narrow particle size distribution-having particles in the seed crystal stage.

In the practice of this invention an embodiment wherein the pAg of the mother liquor containing a protective colloid is at least once above 10.5 during the above particle growth prior to chemical sensitization may be preferably used. It is particularly preferable to pass the particles even once through a very excessive bromide ion-containing atmosphere whose pAg is as high as not less than 11.5, and thus the (111) face is increased by more than 5% to round the particle's shape, whereby the effect of this invention can be further heightened.

In this instance, the increase rate of the (111) face is to that prior to the passing through the pAg atmosphere of the above not less than 10.5, the increase rate should be not less than 10%, and more preferably from 10 to 50% and further preferably from 10 to 20%.

And, consequently, it is preferred when the external surface of the silver halide particle includes the (111) face which occupies an area of not less than 5%, and particularly not less than 20% and more particularly not less than 30% of the whole surface area. Such silver halide particles each having the (111) face occupying not less than 5% of the whole surface area may be obtained in the aforementiond method that is preferred. However, any other methods may be taken to obtain the silver halide particles of the invention.

Whether the (111) face or the (100) face covers the external surface of silver halide particles and in what way the proportional relation between them should be measured and determined are described in the report by Mr. Akira Hirata in the "Bulletin of the Society of Scientific Photography of Japan" No. 13, pp. 5–15 (1963).

In the present invention, whether the (111) face includes an area of not less than 5% or not can be easily confirmed in the Hirata's method by having the particles.

In this instance, the time when making the pAg the above value is prior to chemical sensitization, and preferably between the time when silver ion is added for the growth of silver halide particles and the time before the desalting process, and most preferably from the time upon completion of the addition of silver ion up to the time before the desalting process for the purpose of facilitating the obtaining of a narrow particle size distribution-having monodisperse emulsion.

The ripening under the atmosphere of pAg of not less than 10.5 is desirable to be performed for not less than two minutes.

By such the pAg control the (111) face increases by more than 5% to thereby round the particle's shape.

The silver halide photographic light-sensitive emulsion of this invention is chemically sensitized.

In the present invention, the emulsion is chemically spectol sensitized by containing at least one of those compounds having the foregoing Formulas [I], [II] and [III].

Those compounds of Formulas [I], [II] and [III] will be further explained in detail.

In Formula [I], the unsubstituted alkyl group represented by each of the $R_1$, $R_2$ and $R_3$ includes lower alkyl groups such as methyl, ethyl, n-propyl, butyl, etc. The substituted alkyl group represented by each of the $R_1$, $R_2$ and $R_3$ includes vinyl-methyl group, hydroxyalkyl groups such as 2-hydroxyethyl, 4-hydroxybutyl, etc.; acetoxyalkyl groups such as 2-acetoxyethyl, 3-acetoxybutyl, etc.; carboxyalkyl groups such as 2-carboxyethyl, 3-carboxypropyl, 2-(2-carboxyethoxy)ethyl, etc.; sulfoalkyl groups such as 2-sulfoethyl, 3-sulfopropyl, 3-sulfobutyl, 4-sulfobutyl, 2-hydroxy-3-sulfopropyl, etc.; and the like. The substituted or unsubstituted alkenyl group represented by each of the $R_1$, $R_2$ and $R_3$ includes aryl, butenyl, octenyl and oleyl groups. Further, the substituted or unsubstituted aryl group represented by each of the $R_1$, $R_2$, and $R_3$ includes, e.g., phenyl, carboxyphenyl, and the like groups. Provided, however, as stated earlier, at least one of the $R_1$, $R_2$ and $R_3$ is a sulfoalkyl or carboxyalkyl group.

In addition, in Formula [I], the anion represented by $X_1^-$ includes, e.g., chlorine ion, bromine ion, iodine ion, thiocyanic acid ion, sulfuric acid ion, perchloric acid ion, p-toluene sulfonate ion, ethyl sulfate ion, and the like.

It is preferred that the benzene ring formed with $Z_1$ or $Z_2$ has a substituent, and the substituents include, for example, an alkyl group having 1 to 10 carbon atoms, an alkoxy group having 1 to 8 carbon atoms, a halogen atom, a cyano group, a substituted or unsubstituted phenyl group, an acyl group having 1 to 8 carbon atoms, a dioxymethylene group, a substituted or unsubstituted phenoxy group, an aralkyl group up to those of two-ring type having 7 to 12 carbon atoms, an alkoxycarbonyl group having 2 to 6 carbon atoms, an acylamino group having 1 to 8 carbon atoms, a carbamoyl group having 1 to 8 carbon atoms, a carboxy group, a hydroxy group, and the like. Among them, the preferable case is that a halogen atom is substituted in place of $Z_2$.

The following are typical examples of those compounds having Formula [I], but the present invention is not limited by the examples.

Exemplified Compounds:

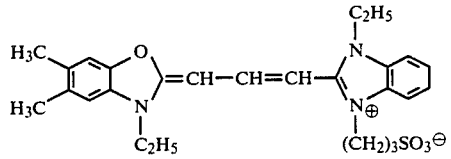
(1)

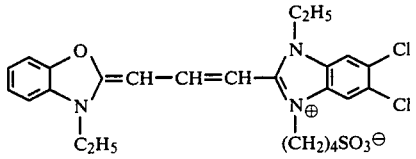
(2)

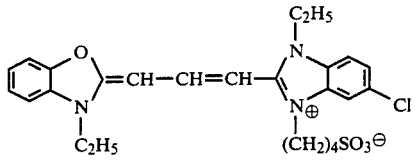
(3)

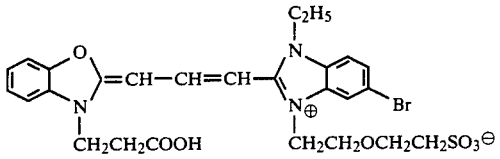
(4)

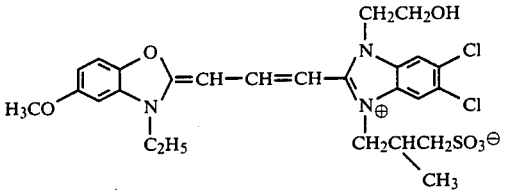
(5)

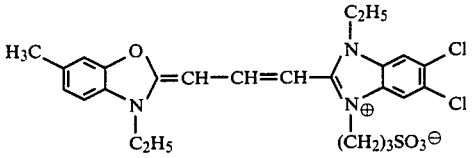
(6)

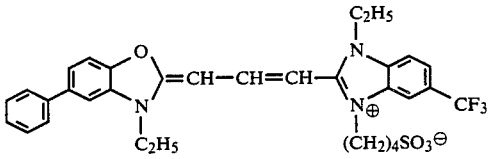
(7)

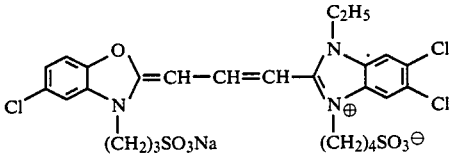
(8)

-continued
(9)
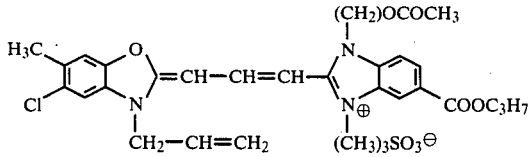
(10)
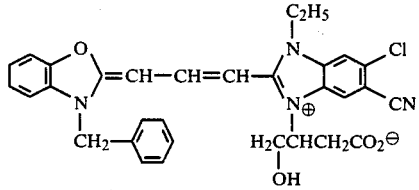
(11)
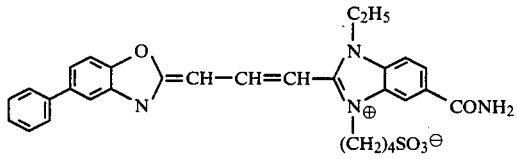
(12)
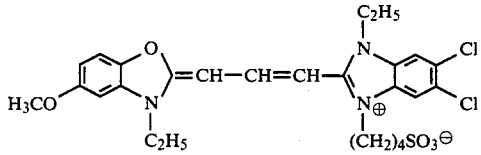
(13)
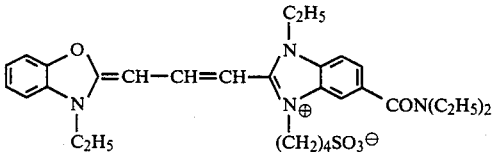
(14)
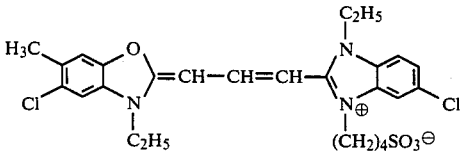
(15)
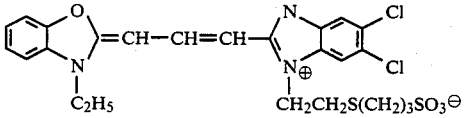
(16)
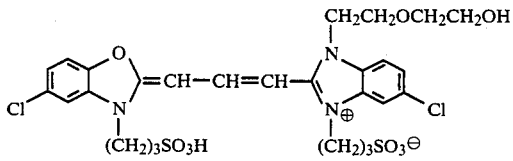
(17)
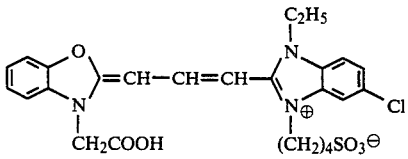
(18)
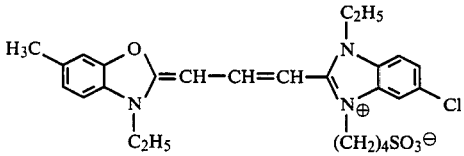
-continued
(19)
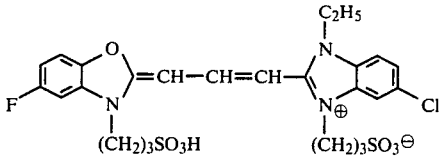
(20)
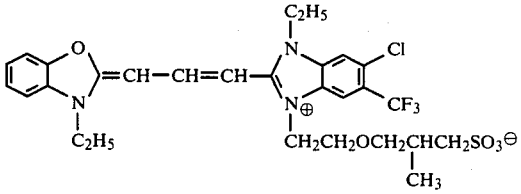
(21)
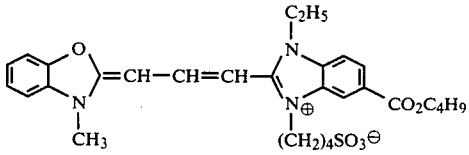
(22)
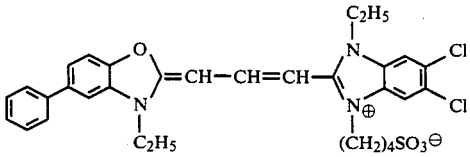
(23)
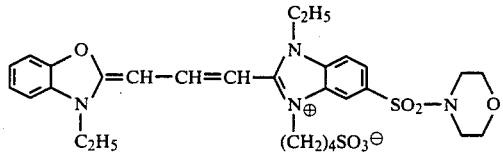
(24)
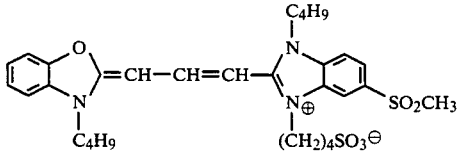
(25)
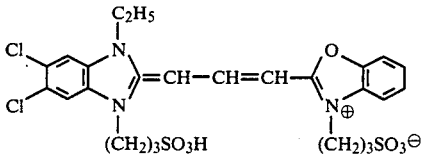
(26)
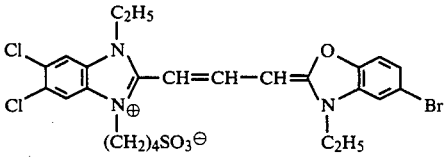
(27)
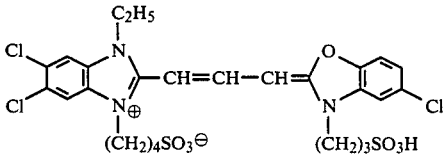

-continued (28)

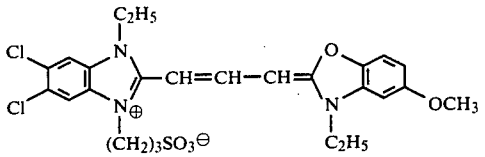

(29)

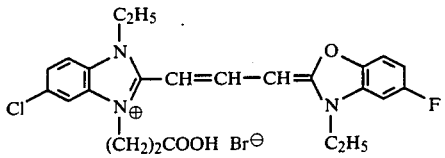

(30)

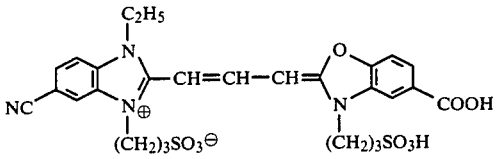

(31)

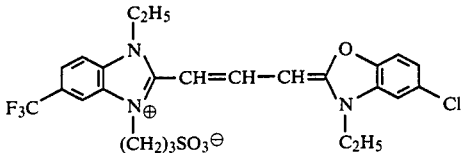

(32)

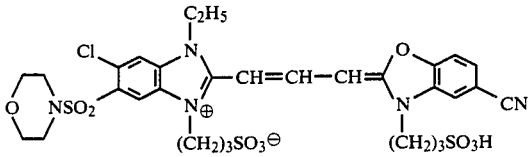

(33)

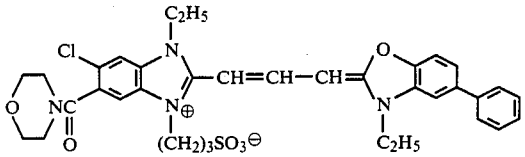

(34)

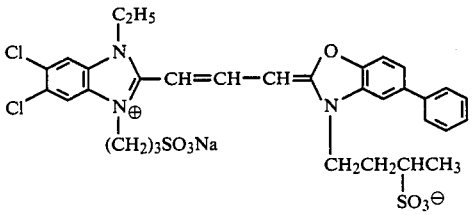

(35)

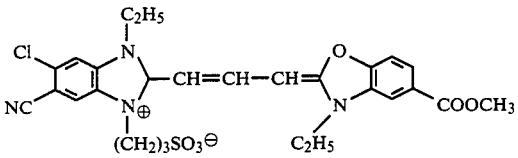

(36)

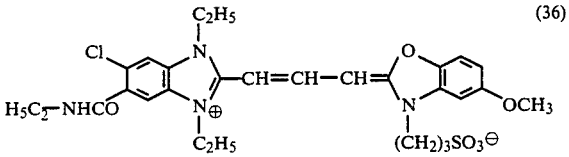

-continued (37)

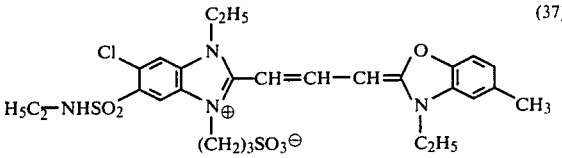

(38)

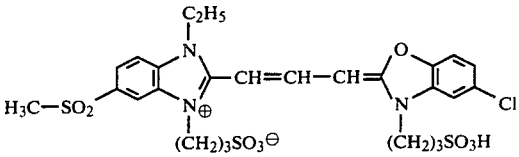

(39)

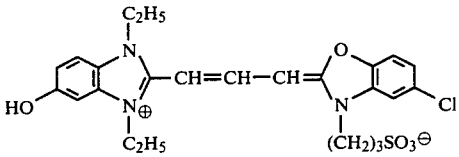

(40)

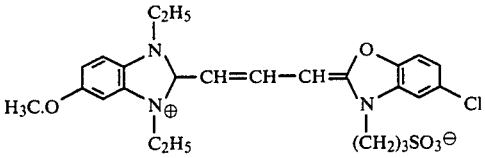

(41)

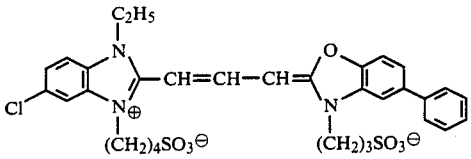

In Formula [II], $R_6$ represents a hydrogen atom, a lower alkyl or aryl group. The lower alkyl group includes methyl, ethyl, propyl, butyl, and the like groups, and the aryl group includes, e.g., phenyl. $R_4$ and $R_5$ are as defined in and each includes the same groups as those exemplified in the $R_1$ and $R_3$ of Formula [I]. $Z_1$ and $Z_2$ each represent a group of non-metal atoms neccesary for forming a substituted or unsubstituted benzene ring, and preferably a substituted benzene ring, and more preferably the substituent thereof is a halogen atom. The anion represented by $X_2^-$ also includes the same ones as those exemplified in the $X_1^-$ of Formula [I].

The following are typical examples of those compounds having Formula [I], but the present invention is not limited to and by the examples.

Exemplified Compounds:

(42)

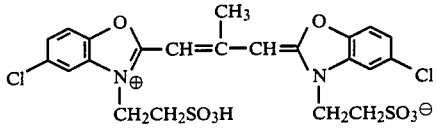

(43)

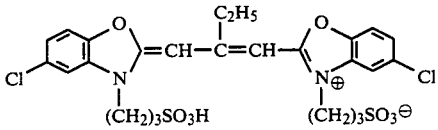

-continued (44)

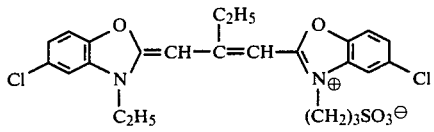

(45)

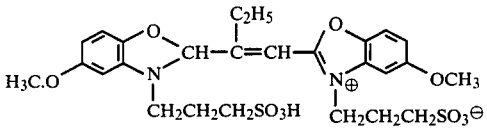

(46)

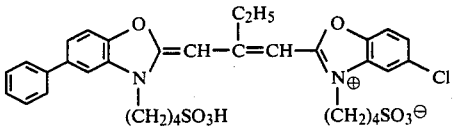

(47)

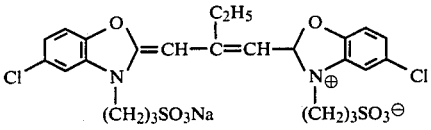

(48)

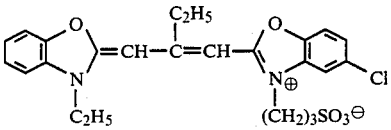

(49)

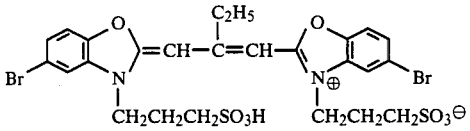

(50)

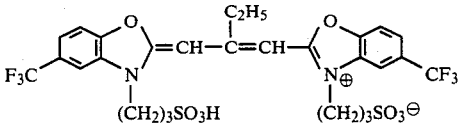

(51)

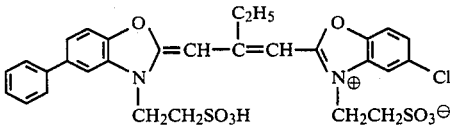

(52)

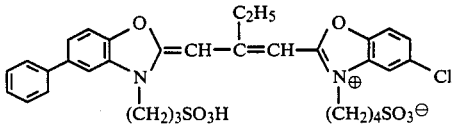

(53)

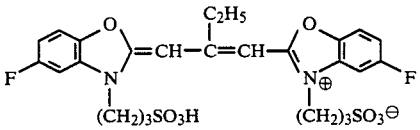

(54)

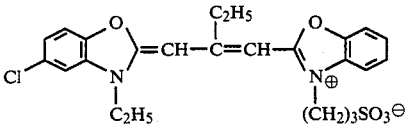

(55)

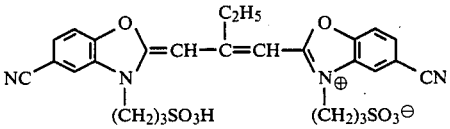

-continued (56)

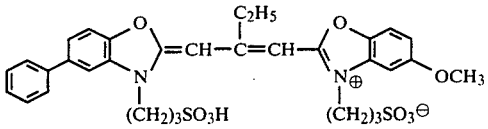

(57)

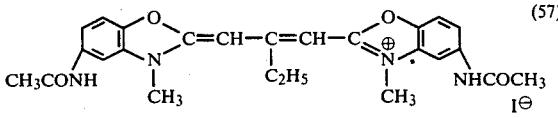

(58)

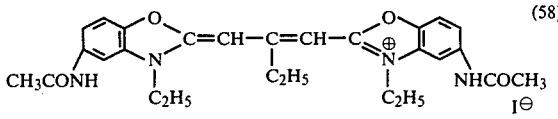

(59)

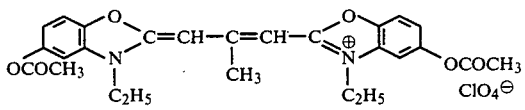

(60)

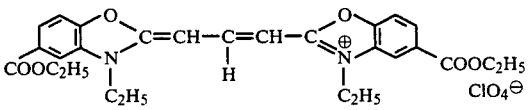

(61)

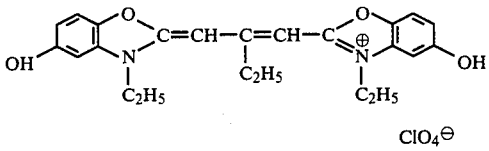

(62)

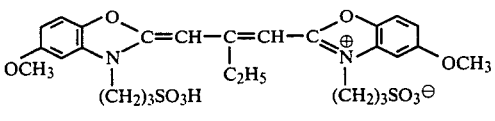

(63)

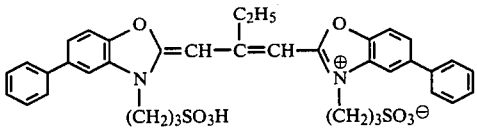

(64)

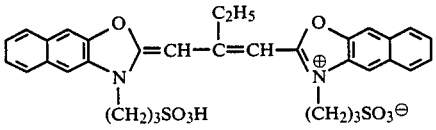

(65)

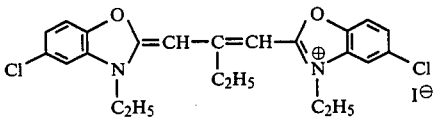

The Formula [III], the unsubstituted lower alkyl group represented by each of the $R_7$ and $R_9$ includes methyl, ethyl, propyl, butyl, and the like groups. The substituted lower alkyl group includes the same ones as those exemplified in the $R_1$ through $R_3$ of Formula [I]. The hydroxyalkyl, sulfoalkyl, or carboxyalkyl group represented by each of the $R_8$ and $R_{10}$ includes the same ones as those exemplified in the $R_1$ through $R_3$ of Formula [I]. The anion represented by the $X_3^-$ also includes the same ones as those exemplified in the $X_1^-$.

The following are typical examples of those compounds having Formula [III]. It goes without saying that the present invention is not limited to the examples, either.

Exemplified Compounds:

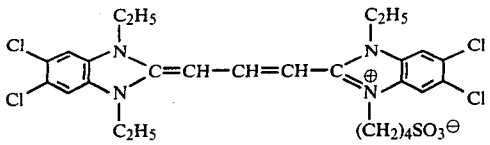
(66)

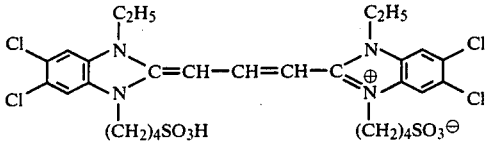
(67)

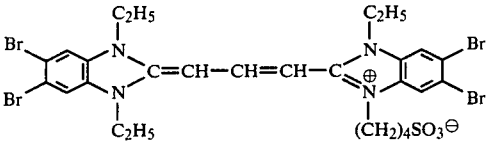
(68)

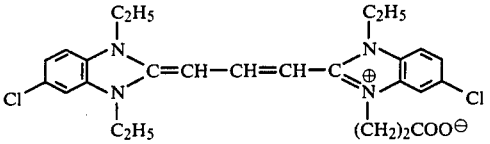
(69)

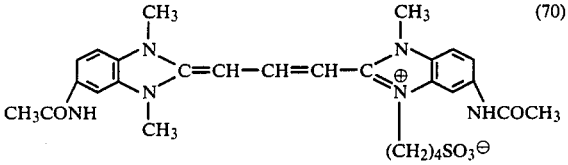
(70)

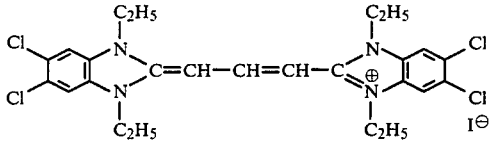
(71)

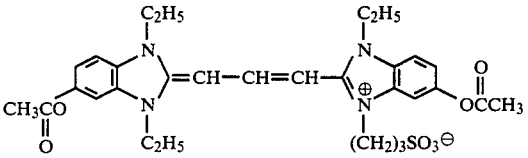
(72)

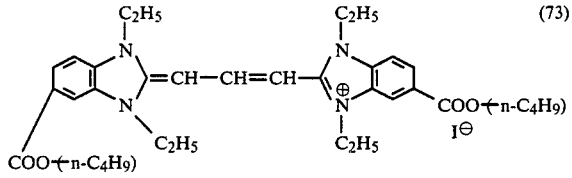
(73)

The total adding amount of any of the compounds having Formulas [I], [II] and [III] is in the range of from 10 mg to 600 mg, and particularly preferably from 15 mg to 450 mg per mole of the silver halide used.

The point of time for sensitization to be made by adding the above-mentioned sensitizing dyes to a photographic emulsion of the invention may be any point in course of the photographic emulsion preparation processes, and preferably a point immediately before, during or after the second ripening process thereof.

The chemical sensitization to be applied to the silver halide particles having grown includes the sulfur sensitization, which uses, e.g., sodium thiosulfate, thiourea compounds, etc., the gold sensitization, which uses a chloroaurate, gold trichloride, etc., the reduction sensitization, which uses thiourea dioxide, stannous chloride, silver ripening, etc., and further the palladium sensitization, the selenium sensitization, and the like. These may be used alone or in combination.

The effect of this invention to improve the resistance against the blackening and desensitization by pressure appears significantly when any of the above chemical sensitizations is applied to the emulsion.

In this instance, the use of the gold sensitization in combination with the sulfur sensitization is preferred.

The thus sensitized silver halide particles have an average particle size of usually from 0.3 to 3 μm.

To the silver halide emulsion of this invention, after being thus chemically sensitized, may be added a stabilizer. The usable stabilizer includes, e.g., 4-hydroxy-6-methyl-1,3,3a,7-tetrazaindene, 5-mercapto-1-phenyl-tetrazole, 2-mercaptobenzothiazole and other stabilizers known to those skilled in the art. The preferred inhibitors include, for example, the compounds described in Japanese Patent Examined Publication No. 13566/1974 and Japanese Patent O.P.I. Publication No. 158631/1983.

The silver halide photographic emulsion of this invention may use a protective colloid as the vehicle thereof, including gelatin, gelatin derivatives, synthetic hydrophilic polymers, and the like, and may also contain various photographic additives.

Photographic additives usable as the hardening agent include aldehyde compounds, ketone compounds, halogen-substituted acids such as mucochloric acid, ethylene imine compounds, vinyl sulfo compounds, and the like. It is also advantageous to use a polymer hardener having a functional group capable of reacting to gelatins, such as described in U.S. Pat. No. 3,671,256, British Pat. No. 1,322,971, and Japanese Patent O.P.I. Publication No. 66841/1981. Those usable as the coating aid include saponin, the lauryl or oleyl monoether of polyethylene glycols, and the like.

Those usable as the development accelerator, although no restrictions are put thereon, include thioether compounds, benzimidazole compounds (e.g., those described in Japanese Patent O.P.I. Publication No. 24427/1974), quaternary ammonium salts, polyethylene glycols, and the like.

Those as the physical characteristics-improving agent include alkyl acrylates, alkyl methacrylates, polymer latexes comprised of homo- or co-polymers of acrylic acid, etc., and the like.

The silver halide photographic emulsion of this invention may also contain an antistatic agent. Those usable as the antistatic agent include compounds obtained by the addition copolymerization of glycidol and ethylene oxide with phenol-aldehyde condensates (e.g., those described in Japanese Patent O.P.I. Publication No. 56220/1976), lanolin-type ethylene oxide addition products and alkali-metallic salts and/or alkaline earth metals (e.g., those described in Japanese Patent O.P.I. Publication No. 145022/1978), water-soluble inorganic chlorides and matting agents (Japanese Patent Application No. 69242/1979), addition-condensation products obtained by the addition condensation of glycidol and ethylene oxide with phenolaldehyde condensates a fluorine-containing succinic acid compound (Japanese Patent Application No. 104940/1977), and the compounds described in Japanese Patent O.P.I. Publication Nos. 200235/1983, 203435/1983 and 208743/1983, and the like.

Further, the emulsion may contain a pH control agent, viscosity increasing agent, graininess improving agent, layer surface-improving matting agent, and the like.

In applying the photographic emulsion of this invention to a silver halide color photographic light-sensitive material, those various known component elements for silver halide color photographic light-sensitive materials may also be made present together with the above various additives without causing any disadvantages. The component elements include, for example, those compounds which react with an oxidized developing agent to produce dyes, i.e., the so-called nondiffusion-type couplers; more particularly, diketomethyl-type yellow couplers, 5-pyrazolone-type magenta couplers, and phenol-type and naphthol-type cyan couplers, and besides, DIR couplers, which release a development inhibitor during color development, and colored couplers, which controls masking densities. These couplers are exemplified in Research Disclosure (R.D.) 9232.

A material used as the support for a light-sensitive material which uses the emulsion of this invention is polyethylene terephthalate film, polycarbonate film, polystyrene film, polypropylene film, cellulose acetate film, or the like. The support film is desirable to be coated with a subbing layer as described in Japanese Patent O.P.I. Publication Nos. 104913/1977, 19941/1984, 19940/1984 and 18949/1984.

The types of the silver halide photographic light-sensitive material to which may be applied the photographic emulsion of this invention include color photographic paper, color negative film, color positive film, black-and-white film (such as fluorographic and radiographic films, graphic arts light-sensitive materials, etc.), photographic light-sensitive materials for the diffusion transfer process, and the like.

For the exposure of the photographic emulsion of this invention any of various light sources, although dependent upon the spectral sensitivity of the emulsion and the purpose for which the emulsion is used, may be arbitrarily used which include tungsten lamp light, fluorescent lamp light, mercury-arc lamp light, arc light, xenon lamp light, the sunlight, xenon flash light, cathod-ray tube flying spot, laser light, electron beam, X-rays, fluorescent screen for the radiography use, and the like.

Time of the exposure may be from 1/1000 to 100 seconds in ordinary exposure, and may also be as short as $1/10^4$ to $1/10^9$ second in the case where a cathod-ray tube or laser light is used.

EXAMPLES

The following are examples of the present invention. The invention is not limited to and by the following examples.

EXAMPLE-1

A polydisperse emulsion ($\sigma/\bar{r}=29.3\%$) was prepared in normal precipitation method as shown in Table 1, I-1

A monodisperse cubic silver iodobromide emulsion containing 2.0 mole% silver iodide, having an average particle size of 0.3 μm, was obtained at its temperature controlled to 60° C., its pAg to 8, and its pH to 2.0, by the double jet method. The produced percentage of twin crystals in the emulsion, by the observation through an electron-microscopic photo, was found out to be not more than 1% by count.

Of this emulsion the quantity corresponding to 6 mole% of the whole silver halide to be used for its growth was used as seed crystal particles and grown as follows:

The seed crystal particles were dissolved into an 8.5-liter solution, kept at 40° C., containing protective gelatin and at need ammonia, and the solution's pH was controlled by the addition of glacial acetic acid thereto.

To this solution as the mother liquor were added to be mixed by stirring a 3.2-normal aqueous ammoniacal silver ion solution and an aqueous halide solution by the double jet method at the flow pattern shown in FIG. 1.

In this instance, by varying as shown in Table 1 the ammonia concentration, pH and pAg of this mother liquor, the silver iodide was localized at various concentrations as shown in Table 1.

Subsequently, the pAg was kept constantly at 9.0, and the pH was varied from 9 to 8 in proportion to the adding quantity of the ammoniacal silver ion to thereby form the shell of pure silver bromide. Any of the emulsions used contains silver iodide in a proportion of about 2 mole% to the whole silver halide thereof.

In the above manner, six different monodisperse emulsions (Nos. I-2 to I-7) as given in Table 1 were prepared.

TABLE 1

| Emulsion No. | Ammonia concentration (N) of initial mother liquor | AgI mol % of localized part | Localized part inner from surface (μ) | pAg when adding iodine ion | pH when adding iodine ion | pAg = 11.5 Ripening | Ratio of (111) face (%) | $\bar{r}$ (μm) | $\sigma/\bar{r} \times 100$ (%) |
|---|---|---|---|---|---|---|---|---|---|
| I-1 | — | 2*[1] | — | — | — | Not ripened | 0 | 0.69 | 29.3 |
| I-2 | 0.2 | 2 | 0.66 | 9.0 | 9.0–8.0 | Not ripened | 0 | 0.68 | 10.5 |
| I-3 | 0.3 | 20 | 0.37 | 7.8 | 9.5 | Not ripened | 0 | 0.71 | 11.4 |
| I-4 | 0.6 | 30 | 0.35 | 7.6 | 9.7 | Not ripened | 0 | 0.68 | 11.9 |
| I-5 | 0.2 | 2 | 0.67 | 9.0 | 9.0–8.0 | Ripened | 11 | 0.69 | 10.7 |
| I-6 | 0.3 | 20 | 0.36 | 7.8 | 9.5 | " | 18 | 0.69 | 11.6 |
| I-7 | 0.6 | 30 | 0.36 | 7.6 | 9.7 | " | 23 | 0.72 | 12.2 |

*[1]Emulsion I-1 contains grains having no AgI-localized part. The value is average AgI concentration.

Each of Emulsions I-5, I-6 and I-7 was ripened at a pAg of 11.5 for three minutes in the final stage of the ripening thereof to thereby round the particles. The mole percentage of the AgI in the localized part of the silver iodide of each emulsion is as shown in Table 1. The thickness of the shell of the silver bromide is about 0.3 μm, and the average particle size is about 0.7 μm.

In addition, the ratios of (111) face were obtained by means of JDX-10R (manufactured by Nippon Denshi K.K.) in accordance with the description by Akira Hirata in the "Bulletin of the Scientific Photography of Japan" No. 13, pp. 5-15 (1963). The results also are shown in Table 1.

To each of the thus obtained emulsions, after being desalted of excessive water-soluble salts by the aggregation precipitation method, were added the sensitizing dyes of this invention and the comparative sensitizing dyes, as shown in Table 2. The added sensitizing dyes are the following exemplified Compounds (2), (47) and (73). Compound (2) is one of the compounds having Formula [I], Compound (47) and Compound (73) are ones of the compounds having Formulas [II] and [III], respectively.

Comparative Dyes:

Comparative Sensitizing Dye (A)

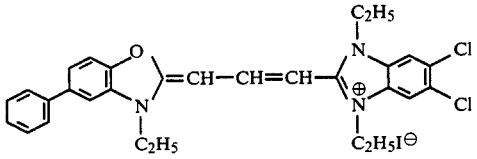

Comparative Sensitizing Dye (B)

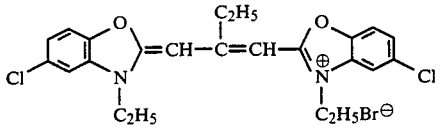

Comparative Sensitizing Dye (C)

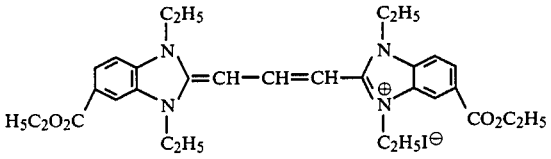

Additives:

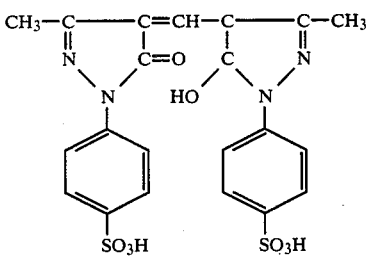

Compound A

-continued

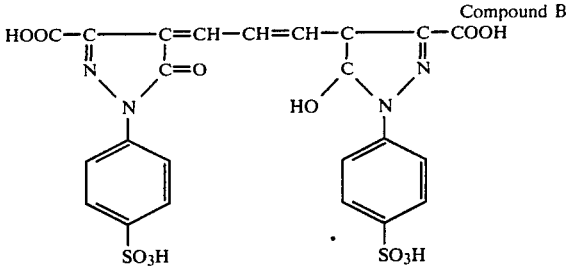

Compound B

Subsequently, ammonium thiocyanate, chloroauric acid and hypo were added to each emulsion for the gold-sulfur sensitization thereof. And ordinary stabilizer, hardener, coating aid and the following compounds A and B were added to the emulsion, and the emulsion was then uniformly coated and dried on both sides of a polyethylene terephthalate film base to thereby obtain a sensitometry sample, the said film base being subbed on both sides thereof with an aqueous copolymer-dispersed liquid obtained by diluting a copolymer so that its concentration becomes 10% by weight, the copolymer being comprised of three monomers: 50% by weight glycidyl methacrylate, 10% by weight methyl acrylate, and 40% by weight butyl methacrylate.

Each sample was subjected to a 3.2 C.M.S. through-wedge exposure and then developed for 90 seconds by an XD-90 developer liquid in a QX-1200 automatic processor, manufactured by Konishiroku Photo Industry Co., Ltd., to thereby obtain the sensitivity of each sample.

The sensitivity of each sample is expressed in terms of the reciprocal of the quantity of light necessary to increase the blackened density by 1.0 in exposure, and indicated with a relative value to the sensitivity of Sample No. 6 regarded as 100 in Table 2. The adding quantity of the sensitizing dye to each sample indicated in the table is a quantity per mole of silver halide.

TABLE 2

| Sample No. | Emulsion No | Added Sensitizing dye No. | Added q'ty (mg) | Fog | Relative speed |
|---|---|---|---|---|---|
| 1 | I-1 | — | — | 0.20 | 80 |
| 2 | I-2 | — | — | 0.21 | 100 |
| 3 | I-3 | — | — | 0.20 | 95 |
| 4 | I-4 | — | — | 0.19 | 95 |
| 5 | I-5 | — | — | 0.19 | 105 |
| 6 | I-6 | — | — | 0.19 | 100 |
| 7 | I-7 | — | — | 0.18 | 100 |
| 8 | I-1 | Exemplified Compound (2) | 85 | 0.20 | 85 |
| 9 | I-2 | Exemplified Compound (2) | 85 | 0.21 | 175 |
| 10 Invention | I-3 | Exemplified Compound (2) | 85 | 0.20 | 400 |
| 11 Invention | I-4 | Exemplified Compound (2) | 85 | 0.19 | 400 |
| 12 | I-5 | Exemplified Compound (2) | 85 | 0.25 | 175 |
| 13 Invention | I-6 | Exemplified Compound (2) | 85 | 0.16 | 500 |
| 14 Invention | I-7 | Exemplified Compound (2) | 85 | 0.16 | 550 |
| 15 | I-1 | Exemplified Compound (47) | 285 | 0.20 | 80 |
| 16 | I-2 | Exemplified Compound (47) | 285 | 0.21 | 150 |
| 17 Invention | I-3 | Exemplified Compound (47) | 285 | 0.20 | 150 |
| 18 | I-4 | Exemplified | 285 | 0.21 | 150 |

TABLE 2-continued

| Sample No. | Emulsion No | Added Sensitizing dye No. | Added q'ty (mg) | Fog | Relative speed |
|---|---|---|---|---|---|
| Invention | | Compound (47) | | | |
| 19 | I-5 | Exemplified Compound (47) | 285 | 0.25 | 175 |
| 20 | I-6 | Exemplified Compound (47) | 285 | 0.16 | 325 |
| Invention | | | | | |
| 21 | I-7 | Exemplified Compound (47) | 285 | 0.15 | 375 |
| Invention | | | | | |
| 22 | I-1 | Exemplified Compound (73) | 200 | 0.20 | 80 |
| 23 | I-2 | Exemplified Compound (73) | 200 | 0.22 | 175 |
| 24 | I-3 | Exemplified Compound (73) | 200 | 0.21 | 150 |
| Invention | | | | | |
| 25 | I-4 | Exemplified Compound (73) | 200 | 0.22 | 150 |
| Invention | | | | | |
| 26 | I-5 | Exemplified Compound (73) | 200 | 0.25 | 175 |
| 27 | I-6 | Exemplified Compound (73) | 200 | 0.16 | 250 |
| Invention | | | | | |
| 28 | I-7 | Exemplified Compound (73) | 200 | 0.15 | 250 |
| Invention | | | | | |
| 29 | I-7 | Exemplified Compound (2) | 80 | 0.15 | 525 |
| Invention | | Exemplified Compound (47) | 250 | | |
| 30 | I-7 | Exemplified Compound (47) | 250 | 0.16 | 225 |
| Invention | | Exemplified Compound (73) | 170 | | |
| 31 | I-7 | Exemplified Compound (73) | 170 | 0.15 | 300 |
| Invention | | Exemplified Compound (2) | 80 | | |
| 32 | I-7 | Comp. dye (A) | 30 | 0.21 | 105 |
| 33 | I-7 | Comp. dye (B) | 90 | 0.80 | 85 |
| 34 | I-7 | Comp. dye (C) | 50 | 0.35 | 95 |

As is apparent from the results given in Table 2, it is understood that the invention-applied samples, i.e., the invention's particles and sensitizing dyes-containing Samples 13, 14, 20, 21, 27, 28, 29, 30 and 31 show that their emulsions all are very highly sensitized and have almost no fog as compared to the other comparative samples. In addition, as for the difference between the uses of Particle I-6, containing 20 mole% intraparticle AgI, and of Particle I-7, containing 30 mole% intraparticle AgI, the latter (30 mole%) proves to tend to cause the sensitivity to be higher from the comparison between samples No. 13 and No. 14 and also from the comparison between Samples No. 20 and No. 21.

EXAMPLE-2

A high-sensitivity silver iodide light-sensitive material, prepared and dye-sensitized in the same way as in Example-1 and having tetradecahedral particles, was used to examine the stability thereof against a safelight. The following Samples No. 41 through No. 50 each was placed for one hour under one meter apart from a safelight consisting of a 20-watt light source with Sakura No. 4A Safelight Filter, and then processed in usual manner. The processed samples each was examined by a densitometer with respect to its fog caused by the safelight and also examined by the eye with respect to residual color stain after the processing. The "Safelight fog" is expressed in terms of the difference in the density between the part exposed to the safelight and the other part not exposed, and as for the residual color, its degree is evaluated at five grades in order from the least color stain. (Color stain grade 1 represents the least color stain, and the grade 5 represents the most color stain.)

Table 3 below exhibits the results of the examinations made with respect to each of the sample emulsions, sensitizing dyes and the added quantity thereof per mole of the silver halide used, as well as the above-mentioned fog and residual color stain.

TABLE 3

| No. | Emulsion No. | Added Sensitizing dye No. | Added q'ty (mg) | Safelight fog | Color stain grade |
|---|---|---|---|---|---|
| 41 | I-1 | Exemplified Compound (2) | 85 | 0.04 | 1 |
| 42 | I-7 | Exemplified Compound (2) | 85 | 0.02 | 1 |
| 43 | I-7 | Exemplified Compound (47) | 285 | 0.02 | 1 |
| 44 | I-7 | Exemplified Compound (73) | 200 | 0.03 | 1 |
| 45 | I-7 | Exemplified Compound (2) | 80 | 0.03 | 1 |
| | | Exemplified Compound (47) | 250 | | |
| 46 | I-7 | Exemplified Compound (47) | 250 | 0.02 | 1 |
| | | Exemplified Compound (73) | 170 | | |
| 47 | I-7 | Exemplified Compound (73) | 170 | 0.03 | 1 |
| | | Exemplified Compound (2) | 80 | | |
| 48 | I-7 | Comp. dye (A) | 30 | 0.05 | 2 |
| 49 | I-7 | Comp. dye (B) | 90 | 0.15 | 3 |
| 50 | I-7 | Comp. dye (C) | 60 | 0.04 | 2 |

As is apparent from the above Table 3, Samples No. 42 to No. 47 of the present invention prove to be excellent in the stability against the safelight and to have almost no color stain.

EXAMPLE-3

A silver iodobromide light-sensitive material was prepared to make samples in the same way as in Example-1, and the samples were conditioned for two hours in an atmosphere of 23° C./35% RH, and under the same condition, the samples each was folded at an angle of about 360° with a curvature radius of 4 mm, and then developed by XD-90 developer in an automatic processor QX-1200. As a result, the folded portion becomes blackened. The blacked degrees of the respective samples are shown in Table 4. The blackened degree is expressed in terms of the difference (ΔD) between the density of the blackened area and the fog density (i.e., the background density).

Table 4 below exhibits the results of the examinations made with respect to teach of the sample emulsions, sensitizing dyes and the added quantity thereof per mole of the silver halide used, as well as the above-mentioned blackened degree.

TABLE 4

| Sample No. | Emulsion No. | Added Sensitizing dye No. | Added q'ty (mg) | ΔD |
|---|---|---|---|---|
| 51 | I-1 | Exemplified Compound (2) | 85 | 0.63 |
| 52 | I-4 | Exemplified Compound (2) | 85 | 0.21 |
| 53 | I-5 | Exemplified | 85 | 0.55 |

TABLE 4-continued

| Sample No. | Emulsion No. | Added Sensitizing dye No. | Added q'ty (mg) | ΔD |
|---|---|---|---|---|
| | | Compound (2) | | |
| 54 | I-7 | Exemplified Compound (2) | 85 | 0.10 |
| 55 | I-7 | Exemplified Compound (47) | 285 | 0.13 |
| 56 | I-7 | Exemplified Compound (73) | 200 | 0.15 |

As is apparent from Table 4, Samples No. 54 through No. 56 of this invention prove to be excellent in the characteristic against the blackening by pressure as compared to the other comparative samples.

EXAMPLE-4

In the same way as in Example-1, emulsions of 36 mole% intraparticle AgI and 2 mole% AgI concentration, of three different average particle sizes: 1.20 μm, 0.80 μm and 0.40 μm, ripened after the particle growth thereof at a pAg of 11.5, were prepared and spectrally sensitized by the sensitizing dye indicated in Table 5. An amount of the sensitizing dyes added is in terms of an amount added per mole of the silver halide used. The three emulsions were mixed as showin in Table 5, and to the mixture were added stabilizer, hardener, coating aid and Compounds A and B (indicated previously), and then coated uniformly and dried in the same way as in Example-1 on a polyethylene terephthalate film based subbed by coating thereon an aqueous copolymer-dispersed liquid, as a subbing liquid, prepared by diluting a copolymer so that its concentration is 10% by weight, the copolymer being comprised of three monomers: 50% by weight glycidyl methacrylate, 10% by weight methyl acrylate and 40% by weight butyl methacrylate, whereby Sample No. 61, to which was applied this invention, was obtained.

On the other hand, a conventional polydisperse emulsion of an average particle size of 0.90 μm was sensitized by the dye and coated and then dried in like manner, whereby a comparative sample No. 62 was obtained.

TABLE 5

| No. | Emulsion | Mixing ratio | Added dye | Added q'ty (mg) |
|---|---|---|---|---|
| 61 | 1.20 μm | 0.7 | Exemplified | 85 |
| | 0.80 μm | 6.0 | Compound (2) | |
| | 0.40 μm | 3.3 | | |
| 62 | Polydisperse emulsion of $\bar{r}$ = 0.90 (μm) | | Exemplified Compound (2) | 85 |

Figure 2:
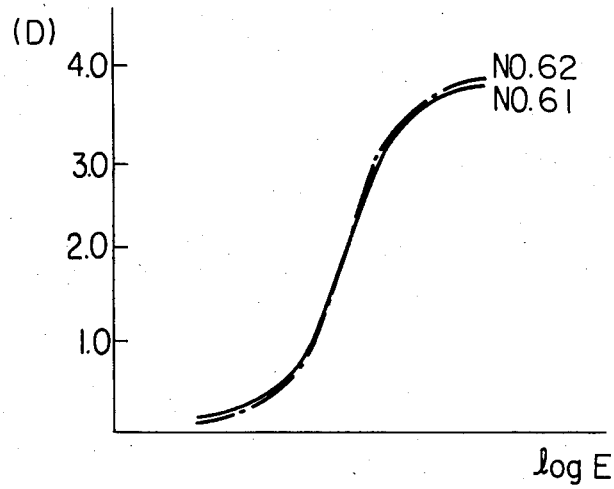
FIG. 2 is a graph showing in comparison the characteristic curves of the sample and the comparative sample in the example.

The two emulsions each was exposed and then developed in the same manner as in Example-1. The obtained characteristic curves are shown in FIG. 2. Thus, Sample No. 61 in this example shows that, by mixing these different particles, a silver halide photographic emulsion having almost the same characteristic curve as that of the conventional polydisperse emulsion (No. 62) can be obtained. Also, by varying the mixing ratio and particle sizes of the monodisperse emulsions, any desired characteristic curve-having silver halide photographic emulsion can be obtained. That is, the preparation of a monodisperse emulsion by the use of the emulsions of this invention enables to obtain a light-sensitive material having similar characteristics to those of conventional polydisperse emulsions, and the combination of the respective particles of this invention enables to produce diverse characteristics-having photographic light-sensitive materials.

What is claimed is:

1. A silver halide photographic light-sensitive emulsion which comprises silver halide particles, chemically sensitized, the average concentration of the silver iodide of which is from 0.5 to 10 mole% and which have inside part wherein not less than 20 mole% silver iodide is present locally; and at least one of those compounds having the following Formulas [I], [II] and [III]:

[I]

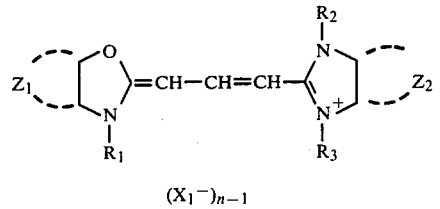

$(X_1^-)_{n-1}$ wherein $R_1$, $R_2$ and $R_3$ each is a substituted or unsubstituted alkyl, alkenyl or aryl group, provided at least one of the $R_1$ and $R_3$ is a sulfoalkyl or carboxyalkyl group; $X_1^-$ is anion; $Z_1$ and $Z_2$ each is a group of nonmetallic atoms necessary to complete a substituted or unsubstituted benzene ring; and n is 1 or 2, provided n is 1 when an intramolecular salt is formed,

[II]

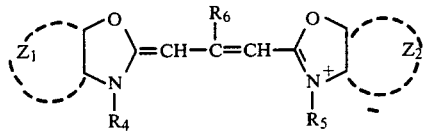

$(X_2^-)_{n-1}$ wherein $R_4$ and $R_5$ each is a substituted or unsubstituted alkyl, alkenyl or aryl group, provided at least one of the $R_4$ and $R_5$ is a sulfoalkyl or carboxyalkyl group; $R_6$ is a hydrogen atom, a lower alkyl or aryl group; $X_2^-$ is anion; $Z_1$ and $Z_2$ each is a group of nonmetallic atoms necessary to complete a substituted or unsubstituted benzene ring; and n is 1 or 2, provided n is 1 when an intramolecular salt is formed,

[III]

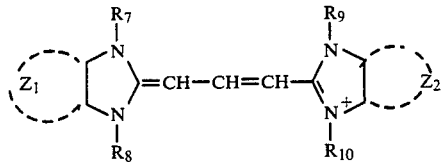

$(X_3^-)_{n-1}$ wherein $R_7$ and $R_9$ each is a substituted or unsubstituted lower alkyl group; $R_8$ and $R_{10}$ each is a lower alkyl, hydroxyalkyl, sulfoalkyl or carboxyalkyl group; $X_3^-$ is anion; $Z_1$ and $Z_2$ each is a group of non-metallic atoms necessary to complete a substituted or unsubstituted benzene ring; and n is 1 or 2, provided n is 1 when an intramolecular salt is formed, said particles grown in a mother liquor, said liquor having a pAg above 10.5 at least once during growth before sensitization.

2. The silver halide photographic light-sensitive emulsion of claim 1, wherein the silver halide of said silver halide particles is substantially silver iodobromide.

3. The silver halide photographic light-sensitive emulsion of claim 1, wherein said part in which silver iodide is present locally is inside of the silver halide particles not less than 0.01 μm from the external surface of said particle.

4. The silver halide photographic light-sensitive emulsion of claim 1, wherein said part in which silver iodide is present locally inside of the silver halide particles not less than 0.02 μm from the external surfaces of said particles.

5. The silver halide photographic light-sensitive emulsion of claim 1, wherein said inside part is present, in the layer form.

6. The silver halide photographic light-sensitive emulsion of claim 1, wherein said silver halide particle comprises a core portion in which silver iodide of not less than 20 mole% in concentration is localized and a shell portion being located outside of said core portion and having silver iodide in a concentration of not more than that of the silver iodide localized in the core portion.

7. The silver halide photographic light-sensitive emulsion of claim 6, wherein said shell portion having silver iodide of not more than 10 mole% in concentration.

8. The silver halide photographic light-sensitive emulsion of claim 6, wherein said shell portion having silver iodide of not more than 5 mole% in concentration.

9. The silver halide photographic light-sensitive emulsion of claim 6, wherein silver content of said shell portion is from 5 to 95 mole% to the silver contents of the whole silver halide particle.

10. The silver halide photographic light-sensitive emulsion of claim 1, wherein the concentration of silver iodide is from 30 to 40 mole% in silver iodide localized portion.

11. The silver halide photographic light-sensitive emulsion of claim 1, wherein the outside of said silver iodide localized portion is covered with a silver halide not containing silver iodide.

12. The silver halide photograhic light-sensitive emulsion of claim 11, wherein the thickness of said covered portion is from 0.01 to 1.5 μm.

13. The silver halide photographic light-sensitive emulsion of claim 11, wherein said sliver halide not containing silver iodide is silver bromide.

14. The silver halide photographic light-sensitive emulsion of claim 1, wherein said silver iodie localized portion comprises a grown part which covers a seed crystal portion and the outside thereof.

15. The silver halide photographic light-sensitive emulsion of claim 14, wherein the silver iodide concentration of said seed crystal portion is not less than 20 mole% in concentration.

16. The silver halide photographic light-sensitive emulsion of claim 14, wherein the silver iodide concentration of said seed crystal portion is from zero to 10 mole% in concentration.

17. The silver halide photographic light-sensitive emulsion of claim 16, wherein the silver iodide concentration of said grown part is not less than 20 mole% in concentration.

18. The silver halide photographic light-sensitive emulsion of claim 1, wherein said silver halide particles are regular crystal.

19. The silver halide photographic light-sensitive emulsion of claim 1, wherein said emulsion contains said silver halide particles in an amount of from 40 to 100% by weight of silver to the whole silver contents thereof.

20. The silver halide photographic light-sensitive emulsion of claim 19, wherein said emulsion has monodispersity having the coefficient of variation ($\sigma/\bar{r}\times 100$) is not more than 20%.

21. The silver halide photographic light-sensitive emulsion of claim 1, wherein said emulsion is prepared in the process having the condition of not less than 10.5 of pAg for not less than two minutes during the particles growth period prior to chemical sensitization.

22. The silver halide photographic light-sensitive emulsion of claim 21, wherein said process is carried out between the time when silver ion is added for the growth of silver halide particles and the time before the desalting process.

23. The silver halide photographic light-sensitive emulsion of claim 1, wherein said silver halide particle has (1.1.1.) face on the surface thereof at a percentage of not less than 5% of the surface area.

24. The silver halide photographic light-sensitive emulsion of claim 1, wherein the contents of at least one of the compounds having Formula [I], [II] and [III] therein are in the range of from 10 to 600 mg per mole of the silver halide used.

* * * * *